US005994832A

United States Patent [19]

Yura et al.

[11] Patent Number: 5,994,832

[45] Date of Patent: Nov. 30, 1999

[54] DISPLAY DEVICE HAVING PLURAL SECOND SUBSTRATES

[75] Inventors: Shinsuke Yura; Shinji Horibata, both of Hyogo, Japan

[73] Assignee: Mitsubishi Denki Kabushiki Kaisha, Tokyo, Japan

[21] Appl. No.: 08/366,376

[22] Filed: Dec. 29, 1994

Related U.S. Application Data

[63] Continuation of application No. 08/006,756, Jan. 21, 1993, abandoned.

[30] Foreign Application Priority Data

Jan. 22, 1992 [JP] Japan ..... 4-009242
Oct. 5, 1992 [JP] Japan ..... 4-265716

[51] Int. Cl.[6] ..... H01J 29/08

[52] U.S. Cl. ..... 313/495

[58] Field of Search ..... 313/495, 496, 313/497

[56] References Cited

U.S. PATENT DOCUMENTS 3,500,102 3/1970 Crost et al. .
4,084,114 4/1978 Kuroda et al. ..... 313/496
4,882,659 11/1989 Gloudemans ..... 313/496
4,950,949 8/1990 van der Wilk ..... 313/495
5,015,912 5/1991 Spindt et al. ..... 313/495
5,185,554 2/1993 Nomura et al. ..... 313/495

FOREIGN PATENT DOCUMENTS 1-100842 4/1989 Japan .

*Primary Examiner*—Sandra O'Shea
*Attorney, Agent, or Firm*—Burns, Doane, Swecker & Mathis, LLP

[57] ABSTRACT

A display device mounted in a vacuum area between the front panel and the first base substrate of a CRT display which includes a plurality of second substrates having electron emitting elements. A plurality of deflection electrodes are mounted around the electron emitting elements and have heights which vary so that they decrease toward a peripheral portion of the second substrate for deflecting derived electrons outward to irradiate a fluorescent surface corresponding to the gaps between the second substrates. According to the plurality of second substrates and the deflection electrodes, a large sized display device can be manufactured.

22 Claims, 15 Drawing Sheets

DISPLAY DEVICE HAVING PLURAL SECOND SUBSTRATES

This application is a continuation, of application Ser. No. 08/006,756, filed Jan. 21, 1993, now abandoned.

BACKGROUND OF THE INVENTION

1. Field of the Invention

The invention relates to a display device for commercial television, computer displays, and displays used for conferences, and more particularly to a flat CRT display device.

2. Description of the Prior Art

FIG. 15 shows a flat display such as that disclosed in the proceedings of the Fourth International Vacuum Micro-Electronics Conference. The display device has a plurality of electron emitting elements which emit electrons under the influence of an electric field. In FIG. 15, the numeral 1 denotes a first base substrate which is made of glass, and the numeral 2 a front glass panel which is made of glass. Numeral 3 indicates a side wall, and 5 a fluorescent film mounted on the front glass panel 2. Cathode electrode 6 emits electrons. The numeral 7 denotes a transparent anode electrode formed on the fluorescent film 5. The interior space surrounded by the first base substrate 1, the front panel 2, and side wall 3 forms a vacuum region, where the degree of vacuum is maintained at about $10^{-3}$~$10^{-5}$ Torr.

Also in FIG. 15, printed wiring 8 leads the cathode electrode 6 to an outside power source (not shown). Printed wiring leads (not shown) the transparent anode electrode 7 to the positive terminal of the outside power source.

The electron emitting elements are formed on the first base substrate 1. The numeral 31 denotes an electron emitting emitter from which electrons are emitted. The electrons are emitted from the emitter 31 to the anode electrode 7 under the influence of the electric field established between the anode electrode 7 and the cathode electrode 6. The numeral 32 denotes a gate electrode which controls the flow of electrons emitted from the emitter electrode 31. The gate electrode 32 and the cathode electrode 6 are arrayed in a matrix in the longitudinal and transverse directions. The brightness of a picture element in the flat CRT display is determined by applying voltage between the gate electrode 32 and the cathode electrode 6 corresponding to the picture element. The emitted electrons are accelerated vertically against the cathode electrode 6 by the anode electrode 7 and strike the fluorescent film 5 to generate light.

Numeral 33 designates an insulation material which separates the gate electrode 32 from the cathode electrode 6.

As mentioned, a detailed description of such a display device is described in the proceedings of the Fourth International Vacuum Micro-Electronics Conference.

It is difficult to manufacture a display device of the above configuration which has a large surface. This is because it is necessary to manufacture a large-sized glass substrate having a plurality of electron emitting elements on it which is the same size as the screen. The electron emitting elements are formed on the glass substrate by precision manufacturing processes such as photolithography, deposition, and etching processes. Since the element size is very small (for example, on the order of microns), failures may occur when fine extraneous materials stick on the electron emitting elements in its fabrication process.

When the size of the display device becomes larger, the probability of failure of a part of the display device increases exponentially. If a failure occurs on any part of the electron emitting elements, the entire display device having the electron emitting elements cannot be used because the effects of the failure appear clearly on the screen. Therefore, it is very difficult to manufacture a screen having a large-sized substrate, for example, on the order of 20~50 inches.

SUMMARY OF THE INVENTION

This invention provides a novel display device which is easy to manufacture as a large-sized display screen.

One aspect of the present invention provides a display device mounted in a vacuum area between the front panel and the first base substrate, which comprises a plurality of second substrates having electron emitting elements which are arranged on the surface thereof.

The second substrate preferably includes a plurality of conductive deflection electrodes mounted around the electron emitting element. The heights of the conductive deflection electrodes are varied so that the height is gradually decreased toward peripheral portion of the second substrate for deflecting derived electrons outward.

The second substrate preferably further includes a plurality of conductive deflection electrodes mounted around the electron emitting element, the conductive deflection electrodes comprising at least one wall which separates the electron emitting element for deflecting emitted electrons outward.

The second substrate preferably further includes a plurality of conductive deflection electrodes mounted in a gap between the electron emitting elements, the conductive deflection electrodes comprising at least one wall for deflecting emitted electrons outward.

At least one support is preferably mounted in the vacuum space between the front panel and the first base substrate.

DETAILED DESCRIPTION OF THE PREFERRED EMBODIMENTS

EMBODIMENT 1

A first embodiment of the present invention is described using FIG. 1~FIG. 5.

Figure 1:
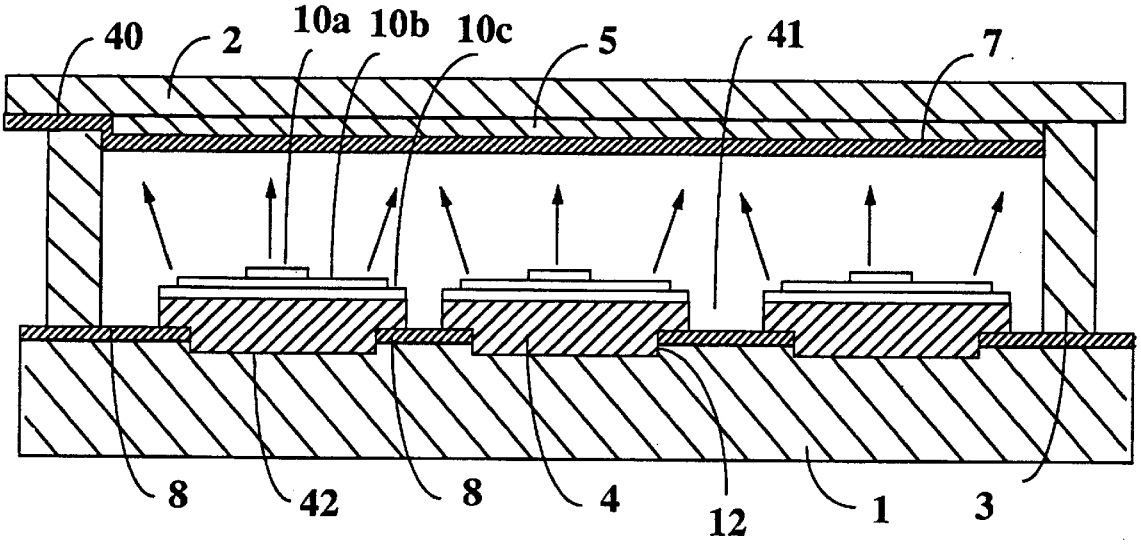
FIG. 1 is a cross sectional view of a display device of a first embodiment of the present invention.

FIG. 1 is a cross sectional view of a display device of a first embodiment of the present invention. The deflection electrodes 10*a*, 10*b*, and 10*c* are not cut away but instead are seen in side profile.

Figure 15:
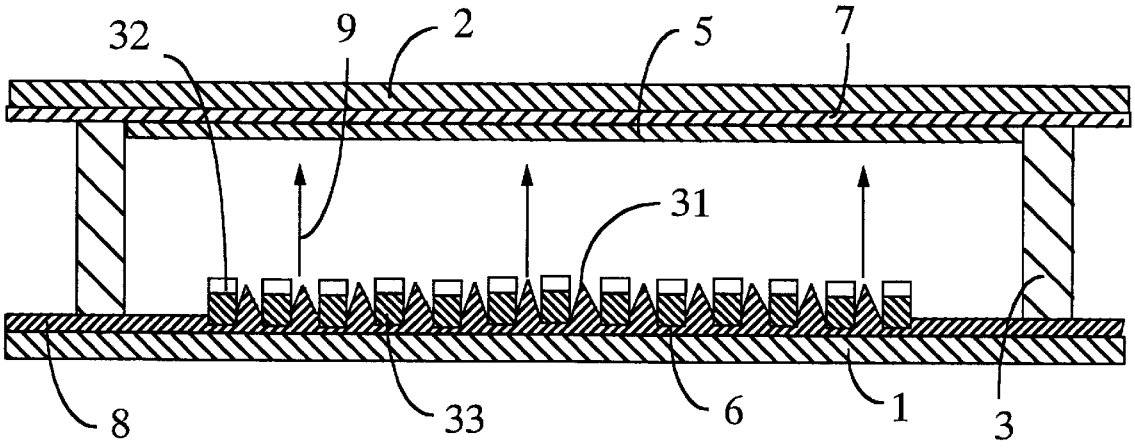
FIG. 15 (Prior Art)
FIG. 15 is a cross sectional view of a conventional display device.

In FIG. 1, the numeral 4 denotes a second substrate on which the electron emitting elements are formed. The electron emitting elements are formed on the second substrate 4 on the first base substrate 1. Printed wiring 8 connects the electron emitting elements between the second substrates 4. Components referred to by the same symbols used in FIG. 1 are identical or comparable to those described in connection with FIG. 15, so further explanation of them will be omitted.

Inside of the front panel 2, the anode electrode 7 is formed on the fluorescent film 5 which is in turn formed on the front panel 2. The anode electrode 7 is comprised of an aluminum thin film conductor which transmits electrons. The anode electrode 7 is connected to the positive terminal of an outside power source through the printed wiring 40. The voltage applied to the anode electrode 7 is 1~5 KV against the cathode electrode 6 (see FIG. 4), which is also connected to the outside power source through the printed wiring 8.

The interior space surrounded by the first base substrate 1, the front panel 2, and the side wall 3 forms a vacuum region, where a vacuum state is maintained the same as described above.

The operation of the first embodiment is described hereinafter. When the appropriate voltage is applied between the anode electrode 7 and the cathode electrode 6 (see FIG. 4) on the second substrate 4 through the printed wirings 40 and 8, (see FIG. 1) respectively, electron emitting elements 13 (see FIG. 4) on the second substrate 4 emit electrons. The emitted electrons are accelerated toward the anode electrode 7 and strike the aluminum thin film. The electrons then pass through the aluminum thin film of electrode 7 and strike the fluorescent film 5, causing the fluorescent film 5 to emit light.

The emission of a picture element is selected by controlling the voltage between the gate electrode 32 and the cathode electrode 6 corresponding to the picture element.

Figure 2:
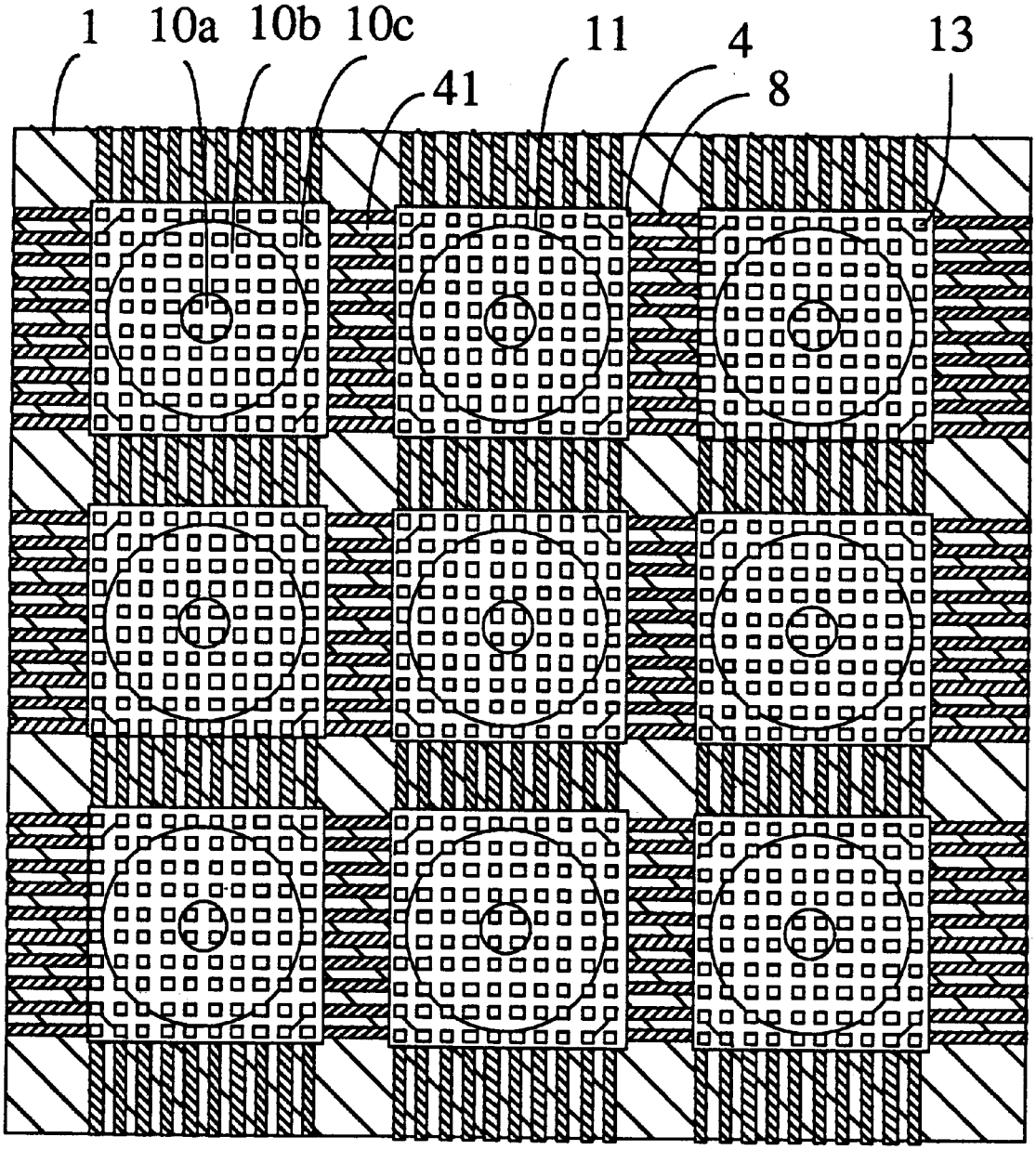
FIG. 2 is a plan view of a base substrate in a display device of a first embodiment of the present invention.

FIG. 2 is a plan view of a base substrate in a display device of a first embodiment of the present invention. In FIG. 2 there are nine second substrates 4, each of which has, for example, a ten by ten matrix of one hundred electron emitting elements 13 on it as shown in FIG. 2. The nine second substrates 4 are mounted on the base substrate 1. The electron emitting elements 13 on the second substrates 4 are connected with the electron emitting elements 13 on the adjacent substrates 4 through the printed wiring 8. Numerals 10*a*, 10*b*, and 10*c* denote deflection electrodes which are mounted around the electron emitting elements 13 and made of metal.

Since there are no electron emitting elements on the separated portion 41 between the second substrates 4, the electrons are not emitted from the separated portion 41. Therefore, unless additional measures are employed, light cannot be emitted from the fluorescent thin film 5 located over the separated portion 41.

In this first embodiment, three deflection electrodes 10*a*, 10*b*, and 10*c* are formed on the second substrate 4. The electrons emitted from the cathode electrode are deflected by the influence of the deflected electrode so that the electrons reach areas of the fluorescent film 5 corresponding positionally to the separated portion 41. Therefore, all of the surface of the fluorescent thin film 5 can be irradiated with electrons by controlling the voltage of the deflection electrodes 10*a*, 10*b*, and 10*c*.

Figure 3:
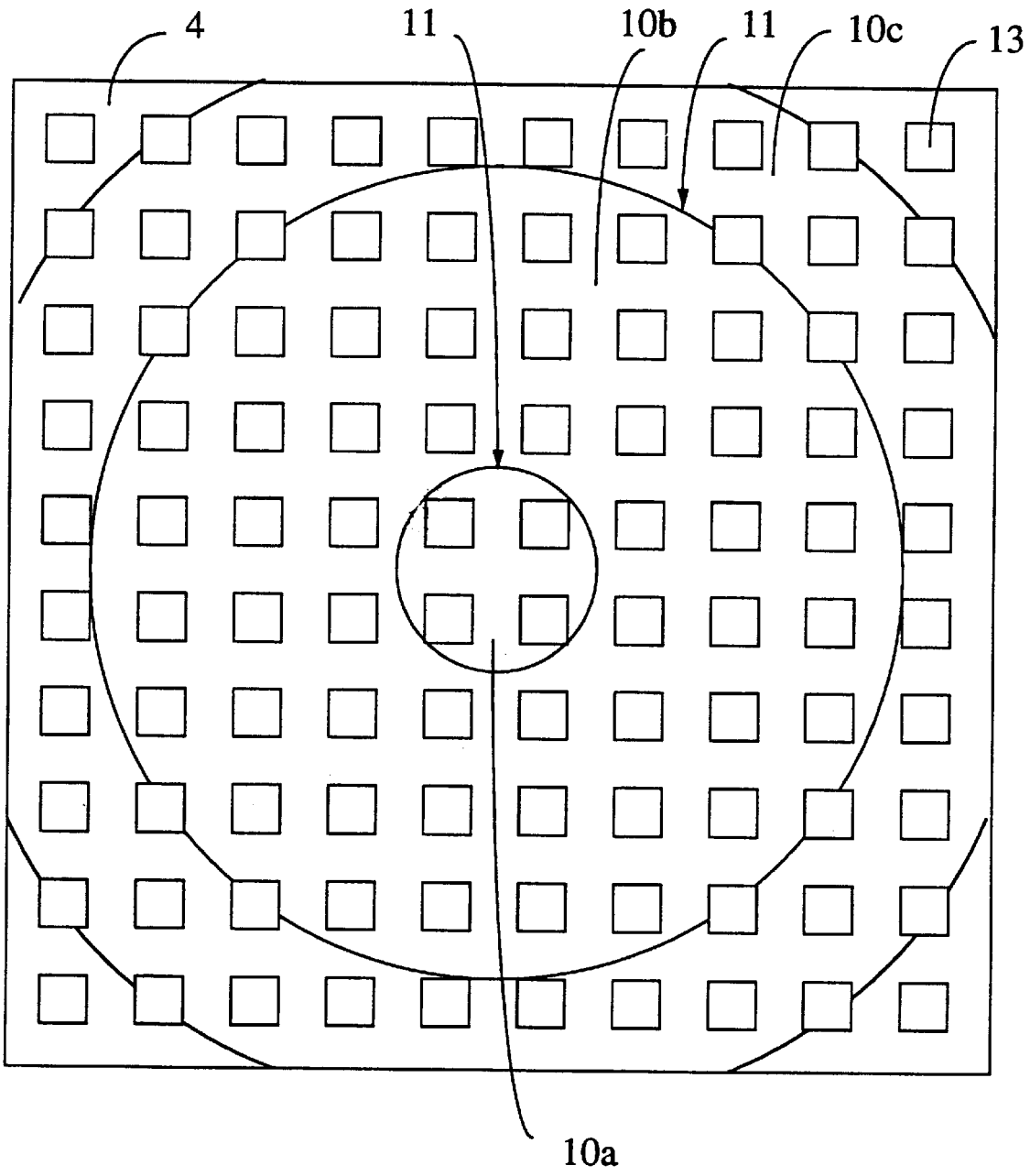
FIG. 3 is a plan view of a second substrate having electron emitting elements thereon of a first embodiment of the present invention.

FIG. 3 is a plan view of a second substrate 4 having electron emitting elements 13 thereon wherein the shape of the second substrate 4 is square. On the second substrate 4, a ten by ten matrix of one hundred emitting elements are arrayed. Numerals 10*a*, 10*b*, and 10*c* designate deflection electrodes which are mounted around the electron emitting elements 13 and are made of metal. The numeral 11 designates the location of a height difference between the deflection electrodes 10*a* and 10*b*, or 10*b* and 10*c* (also see FIG. 4).

Figure 4:
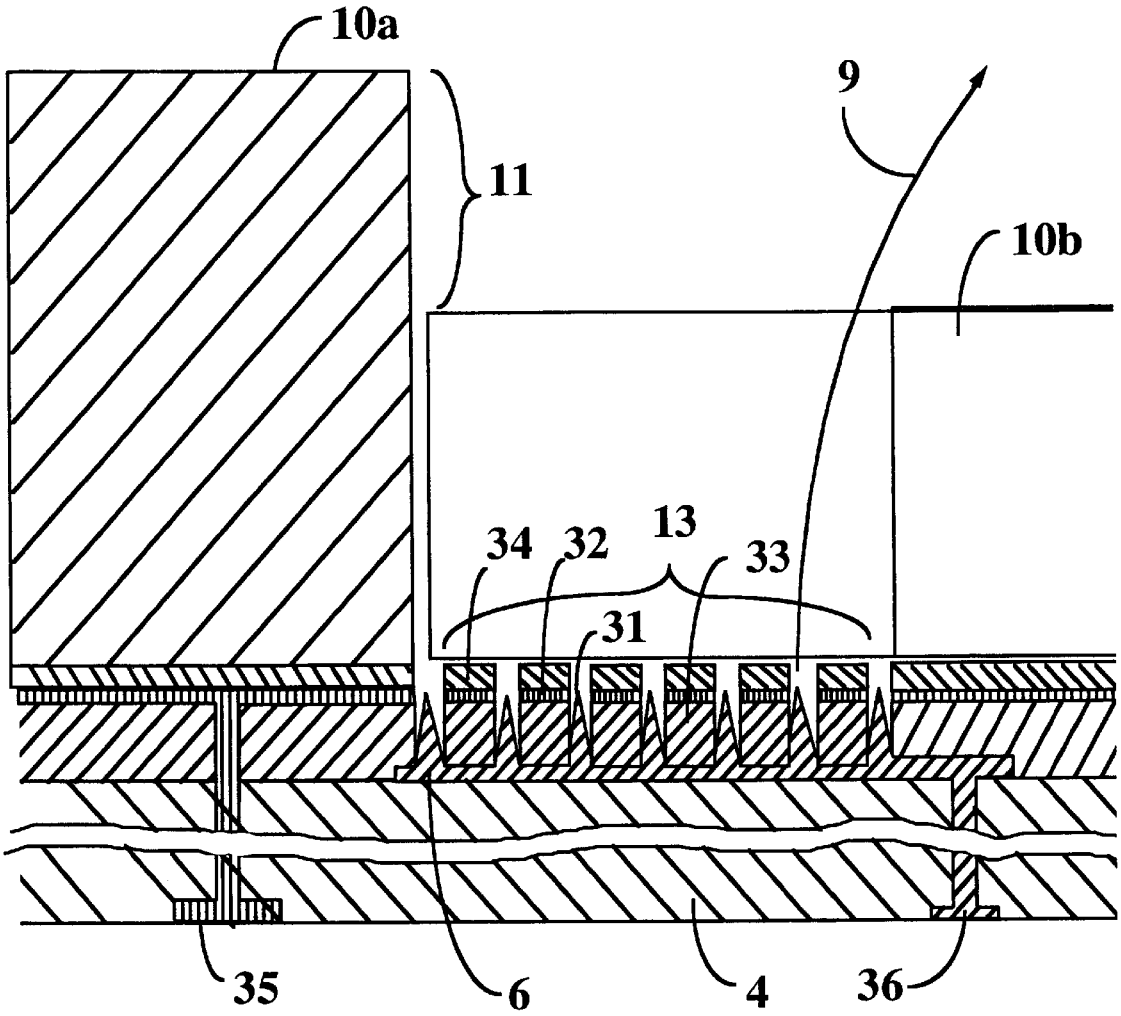
FIG. 4 is an enlarged partial cross sectional view of a display device of a first embodiment of the present invention taken along line I—I of FIG. 5.
Figure 5:
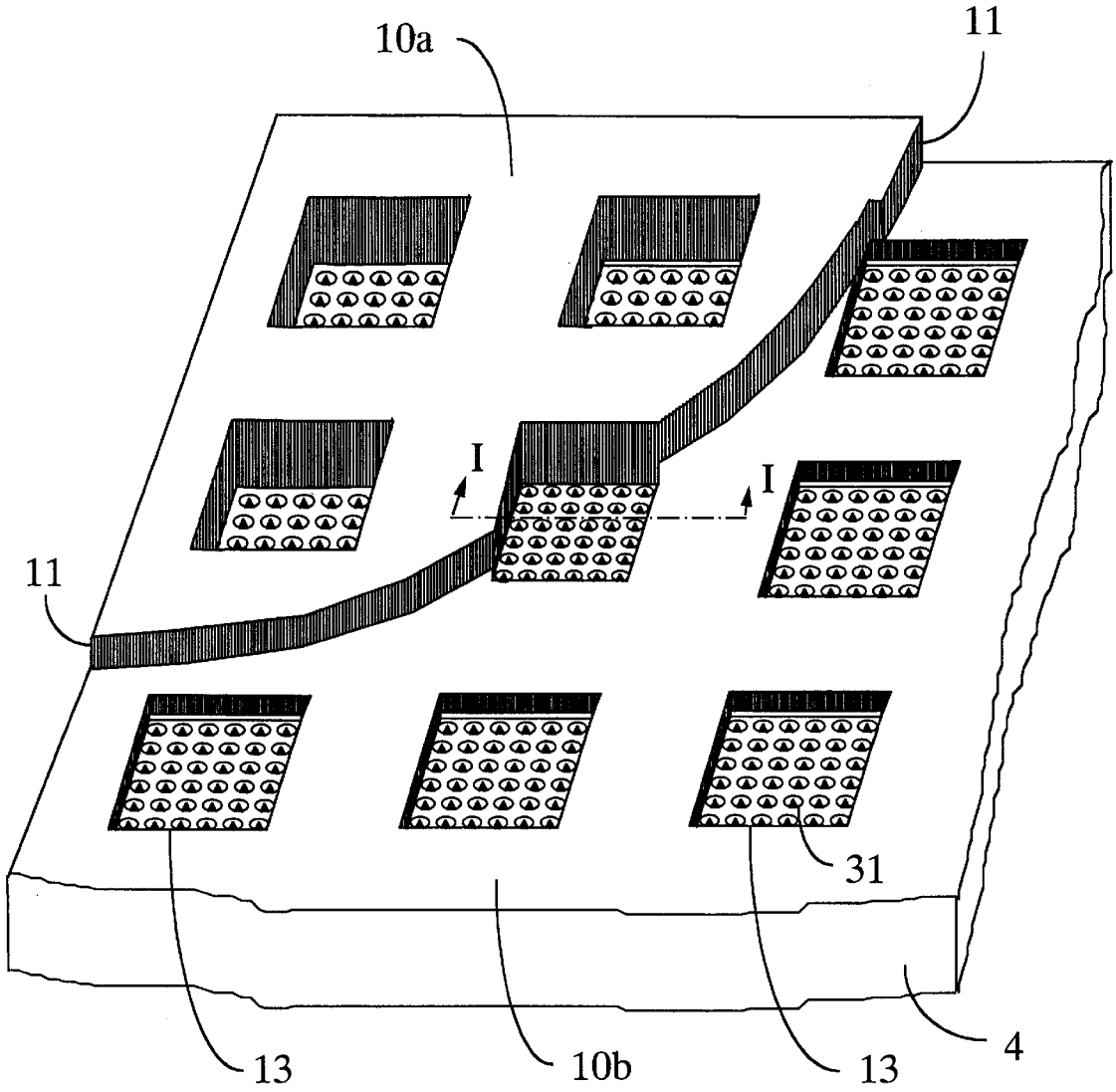
FIG. 5 is a perspective view of a display device of a first embodiment of the present invention.

FIG. 4 is an enlarged partial cross sectional view along line I—I of FIG. 5 of a display device of a first embodiment of the present invention. In FIG. 4, the numeral 31 denotes an electrical field emitting emitter, 32 a gate electrode, and 33 and 34 insulating layers which insulate the gate electrode 32 from the cathode electrode 6 and deflection electrodes 10*a*, 10*b*, and 10*c* as described below. The deflection electrodes 10*a*, 10*b*, and 10*c* are comprised of a metal and have different heights on the second substrate 4 via the insulating layers 34. In this embodiment, the height of the deflection wall decreases toward the radial direction, such that the deflection electrode 10*a* is the highest, 10*b* is of an intermediate height, and 10*c* is the lowest. The numeral 11 denotes a height difference between the deflection electrodes 10*a* and 10*b*, or 10*b* and 10*c*.

Numeral 9 denotes the path of an emitted electron generated at the electric field emitting emitter 31. That is, the electron emitted from the electric field emitting emitter 31 is deflected by the negative voltage applied to the deflection electrodes 10*a*, 10*b*, and 10*c*. The deflection angle is determined by the height difference and the negative voltages applied to the deflection electrodes 10*a*, 10*b*, and 10*c*. Since the height of the inside deflection electrode 10*a* is greater than that of the middle electrode 10*b* and still greater than that of the outer electrode 10*c*, the electron is deflected radially outwardly as shown in FIG. 4.

FIG. 5 is a perspective view of a display device of a first embodiment of the present invention. In FIG. 5, the height difference 11 between the deflection electrodes 10*a* and 10*b* is clearly shown. Only nine of the electron emitting elements 13 are shown near the height difference 11 between the deflection electrodes 10*a* and 10*b*. The electron emitting elements 13 are more deeply recessed from the surface of the highest deflection electrode 10*a* than the electron emitting elements 13 are from the surface of the middle height deflection electrode 10*b*.

The second substrate 4 has an extended portion 12 for every side at the bottom thereof as shown in FIG. 1. The extended portion 12 is fitted into the recess portion 42 on the top surface of the base substrate 1. These recesses 42 of the base substrate 1 and the extended portion 12 of the second substrate 4 facilitate alignment between the base substrate 1 and the second substrate 4 at an exact position.

The metal print wiring 8 is printed on the base substrate 1 to connect between the cathode electrodes 6, and between the cathode electrodes 6 and the outer power source. On the other hand, electrode connection terminals 35 and 36 (see FIG. 4) extend from every side of the bottom of the second substrate 4 from where they are connected with outer terminals. A solder bump is formed on the print wiring 8 before the second substrate 4 is put on the first substrate 1. After the second substrate 4 is put on the first substrate 1, appropriate heat is applied to the first substrate in order to solder the electrode connection terminals 35 and 36 with the print wiring 8.

EMBODIMENT 2

A second embodiment of the present invention is described using FIG. 6—FIG. 9. These components referred to by the same symbols in FIG. 1—FIG. 5 are identical or comparable to those described in the earlier figures so that their explanation will be omitted.

Figure 6:
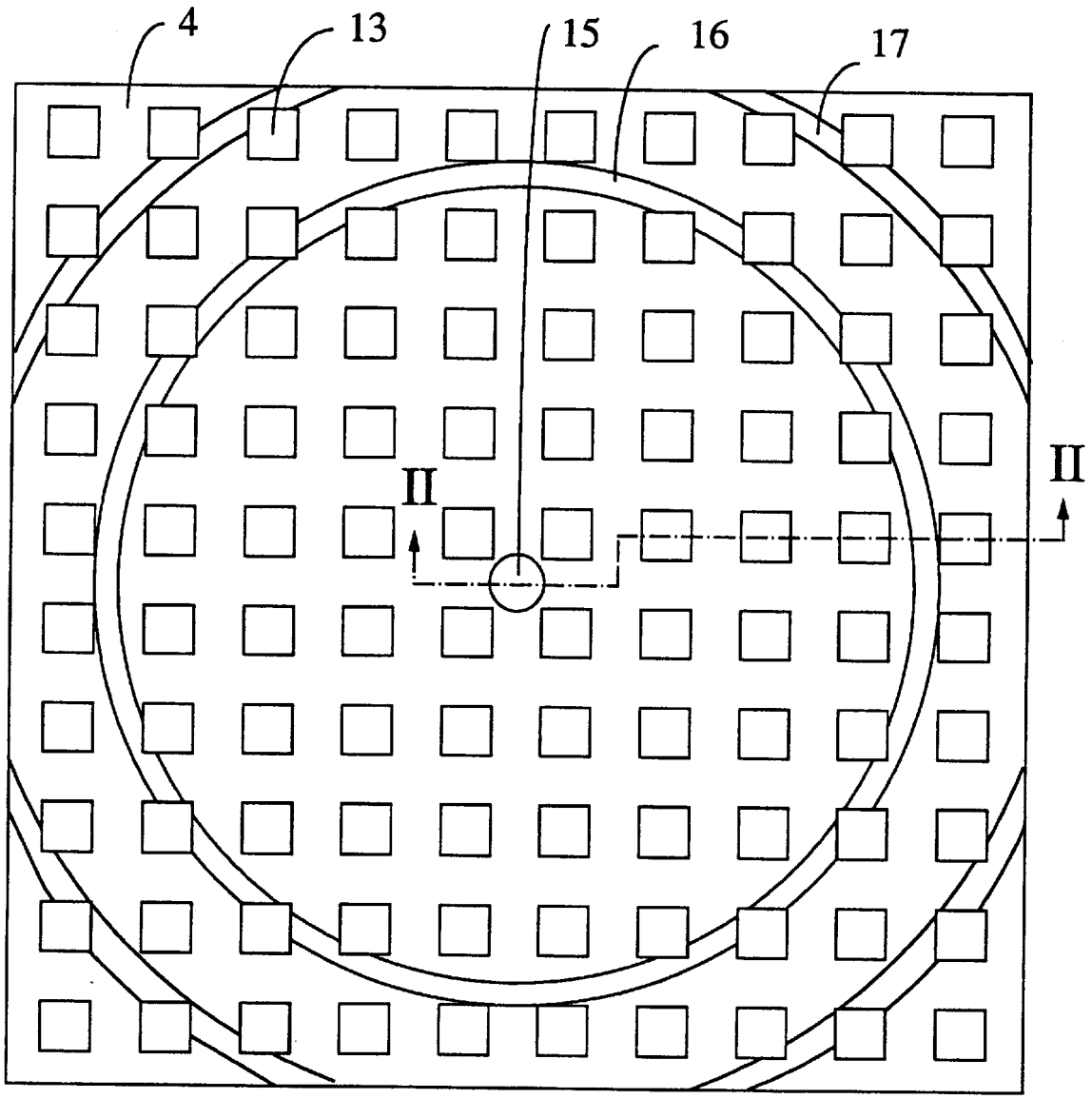
FIG. 6 is a plan view of a second substrate having electron emitting elements thereon of a second embodiment of the present invention.

FIG. 6 is a plan view of a second substrate 4 having electron emitting elements 13 thereon. The shape of the second substrate 4 is square. A 10×10 matrix of one hundred electron emitting elements are arrayed on the second substrate 4. The numeral 15 denotes a central deflection electrode which is mounted at the center of the second substrate 4. The numeral 16 designates an intermediate deflection electrode which is mounted on the second substrate 4 in the form of a hollow circle which is concentric with central deflection electrode 15. The numeral 17 indicates an outer deflection electrode which is mounted on the second substrate 4 concentrically with and radially outward of the intermediate deflection electrode 16.

The deflection electrodes 15, 16 and 17 are comprised of concentric walls having a width of about 50 $\mu$m, respectively, which are formed by plating with a metal such as nickel. The heights of the electrodes 15, 16, and 17 are substantially the same. The voltages applied on each electrodes 15, 16 and 17, however, are different from each other. The voltage applied on the outer electrode 17 is higher than that applied to the intermediate electrode 16. The voltage applied on the intermediate electrode 16 is higher than that applied to the central electrode 15 in the same manner.

Figure 8:
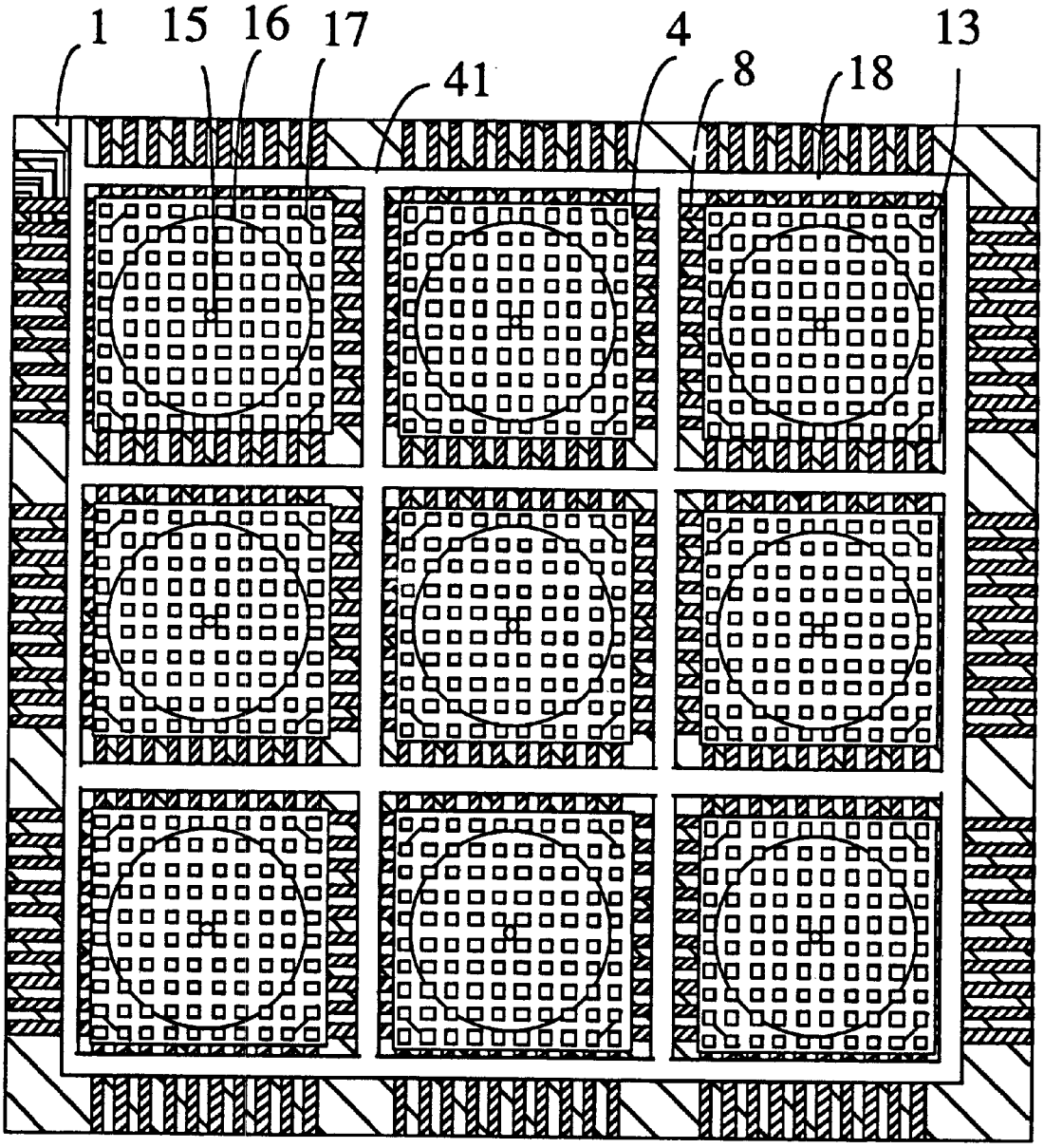
FIG. 8 is a whole plan view of a third embodiment of the invention incorporating another version of a deflection electrode.

FIG. 8 is an entire plan view of a base substrate in a display device. The base substrate is as according to a second embodiment of the present invention. In FIG. 8, there are nine separated second substrates 4 on the first base substrate 1. Each of the second substrates 4 is connected by the printed wiring on the first base substrate 1. In addition, FIG. 8 also shows another possible version of a deflection electrode structure. The combination of this electrode structure together with a substrate as just described constitutes a third overall embodiment of the invention.

Figure 7:
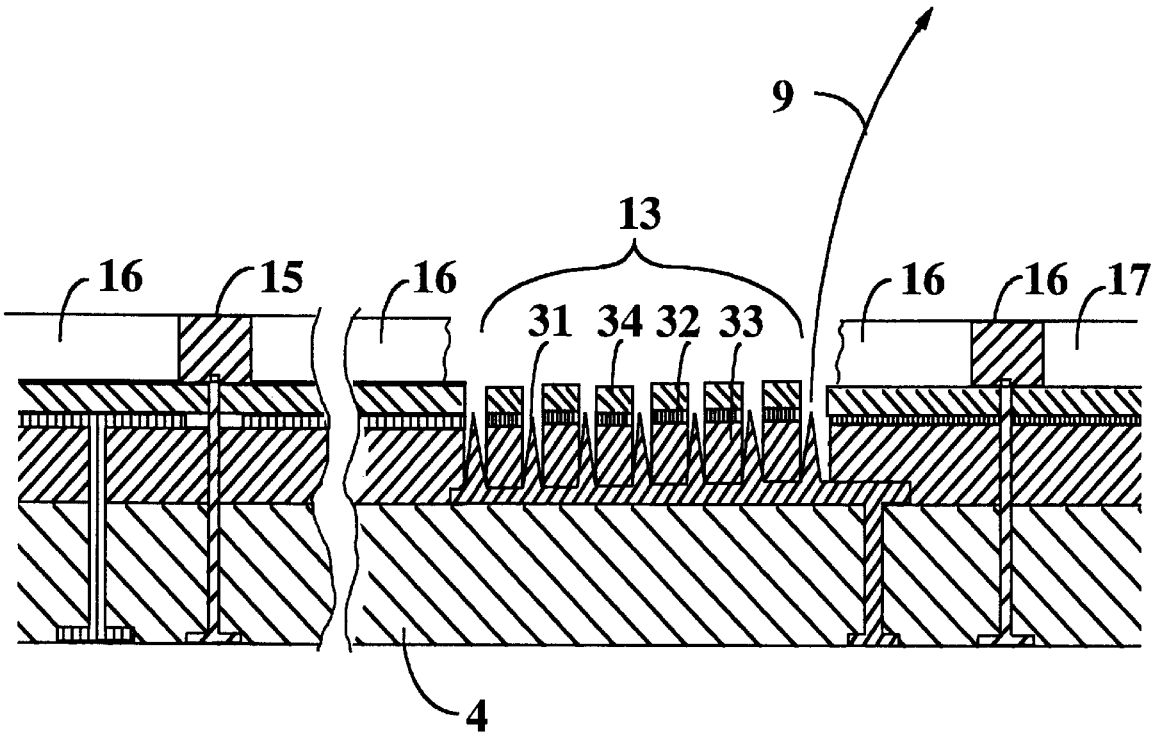
FIG. 7 is a partial cross sectional view of a display device of a second embodiment of the present invention taken along line II—II of FIG. 6.
Figure 9:
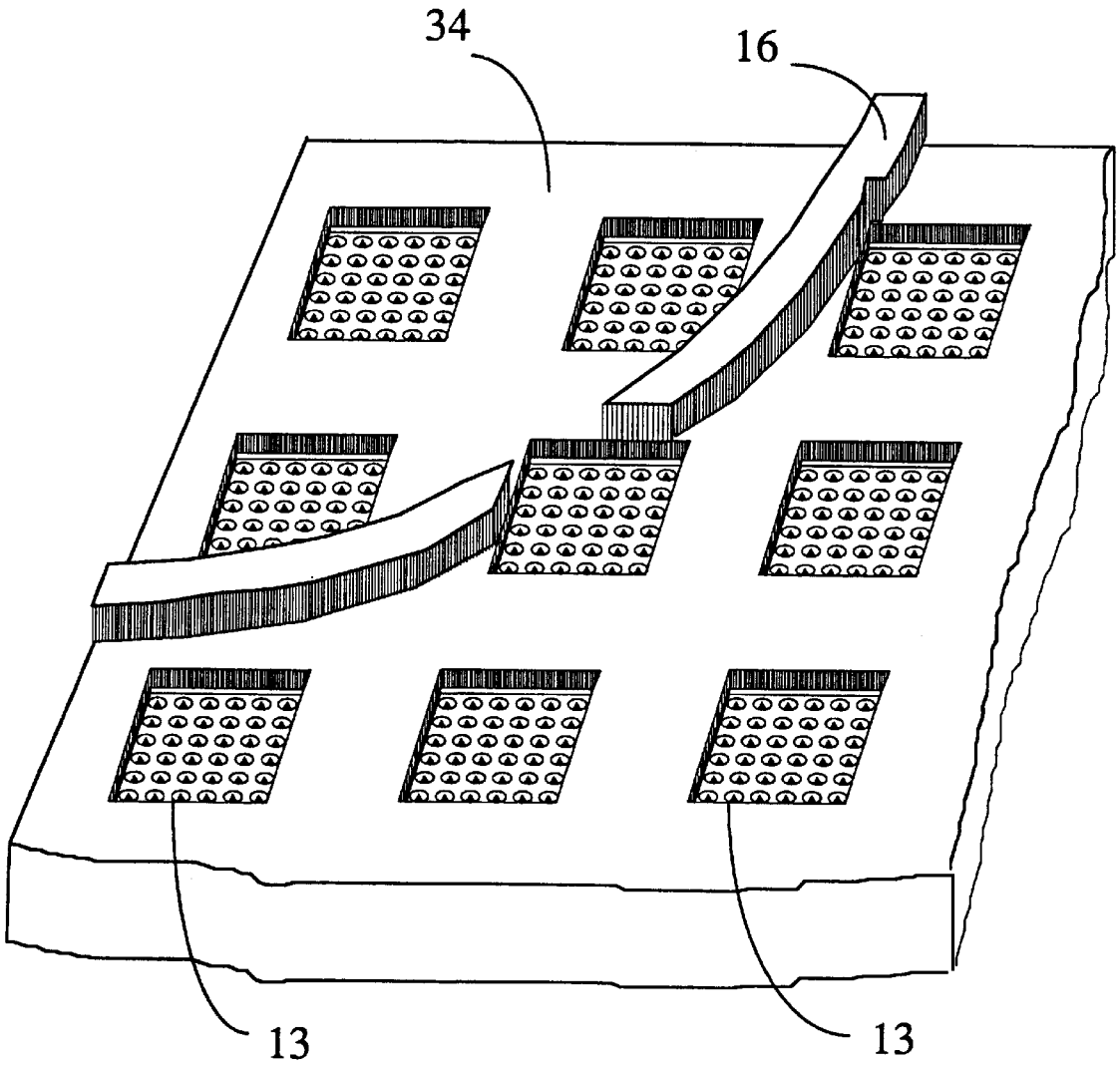
FIG. 9 is a perspective view of a display device of a second embodiment of the present invention.

FIG. 7 is a partial cross sectional view along line II—II in FIG. 6 of a display device of a second embodiment of the present invention. FIG. 9 is a perspective view of a display device according to a second embodiment of the present invention.

An electron emitted from the electric field emitting emitter 31 is caused to curve outside along an electron path 9 as shown in FIG. 7 by the influence of the electric field established by the deflection electrodes 15, 16, and 17. The deflection electrodes 15, 16, and 17 lead to the bottom of the second substrate 4 and are connected to the printed wiring on the base substrate 1 during heating the base substrate 1 after the second substrate is fitted on the base substrate 1 in the same manner described above.

EMBODIMENT 3

As mentioned, also in FIG. 8, the numeral 18 denotes a deflection electrode according to a the third embodiment of the present invention, mounted on the separated portion 41 between the second substrates 4. Much higher voltage is applied to the deflection electrode 18 than the voltage applied to the deflection electrodes 17. The electrons emitted from the electric field emitting emitter 31 near the edge of the second substrates 4 curve outside. As a result of the curved path for the electrons, the fluorescent thin film 5 located over the separated portion 41 is suitably irradiated with electrons. The cross-sectional shape of the deflection electrode 18 is the same as that of the deflection electrodes 15, 16 shown in FIG. 7.

EMBODIMENT 4

Figure 10:
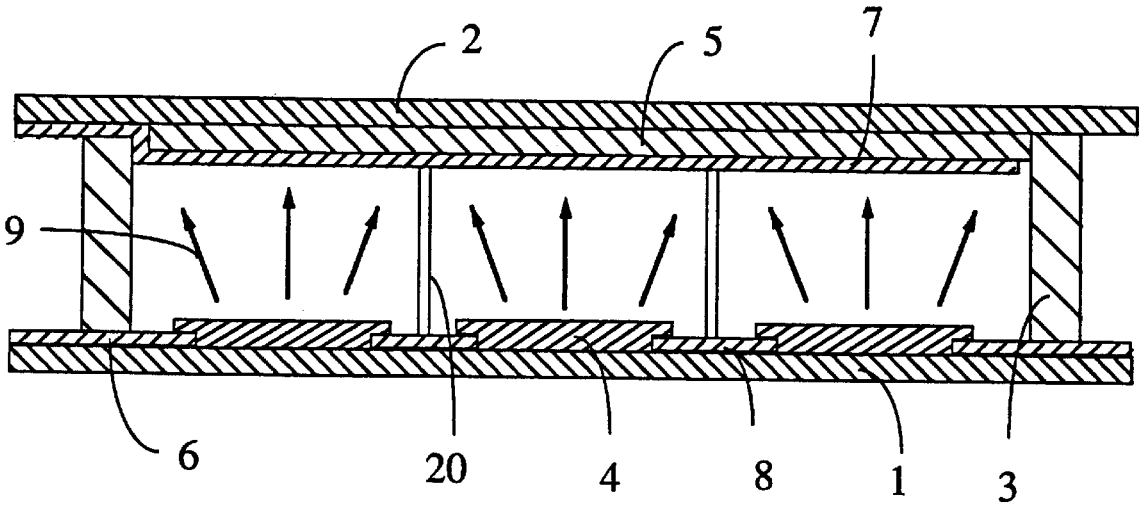
FIG. 10 is a cross sectional view of a display device of a fourth embodiment of the present invention.

FIG. 10 is a cross sectional view of a display device of a fourth embodiment of the present invention. The components referred to by the same symbols in FIG. 10 are identical or comparable to those explained above so that and their explanation will be omitted here.

When it is desired that the display device is wide, its surfaces are apt to deform because atmospheric pressure is applied to the wide front panel 2. If the surface of the front panel 2 is deformed, the display characteristics degrade. To prevent this deformation, supports 20 are mounted in the space between the front panel 2 and the base substrate 1. The supports 20 comprise photosensitive glass and are affixed to the front panel 2 and the base substrate 1 by the frit glass. By mounting the supports 20 between the front panel 2 and the base substrate 1, a large screen using the display element can be manufactured easily.

In the first and the second embodiments, nine second substrates 4 are arranged in 3×3 matrix on the base substrate 1, but more second substrates 4 may be arranged on the base substrate 1 if a larger size of the display screen is required. In the above embodiment further 10×10 electrodes are mounted in one second substrate 4, but much more electrodes may be mounted in one second substrate 4. If the second substrate having the size 50×50 mm is arranged in 10×10 matrix, a 30 inch wide display device may be manufactured.

In the above embodiments, the shape of the second substrate 4 mounting electron emitting elements thereon is square, but it may be rectangular, regular hexagon or any other shape if the entire surface is filled with the second substrates 4 without gaps therebetween.

Also, in these embodiments, the number of the deflection electrodes is three, but it may be more or less than three. And also, the deflection electrode may be a square shape or a hexagon shape or other polygon shape.

Figure 11:
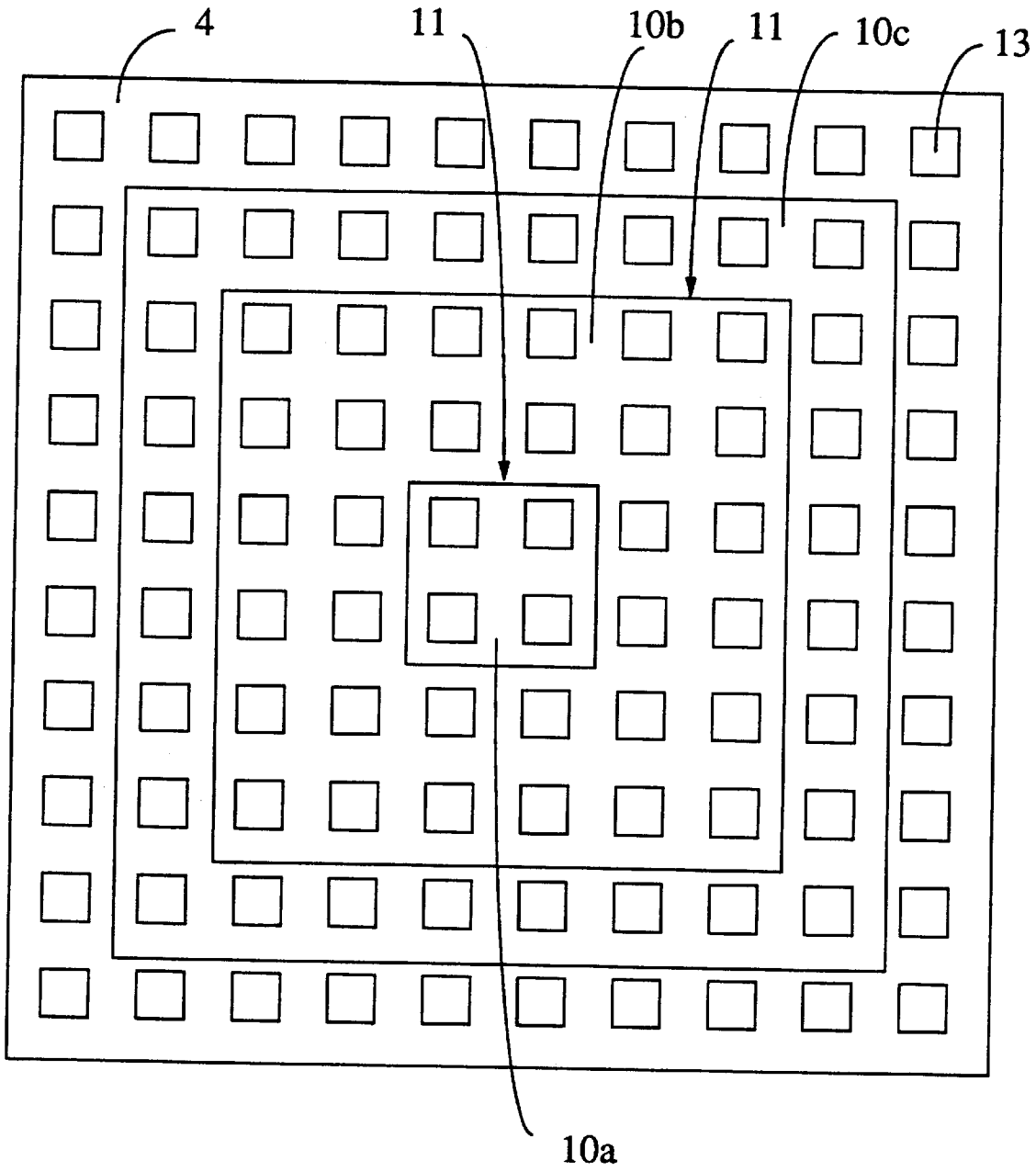
FIG. 11 is a plan view of a second substrate wherein a shape of the deflection electrode is square.
Figure 12:
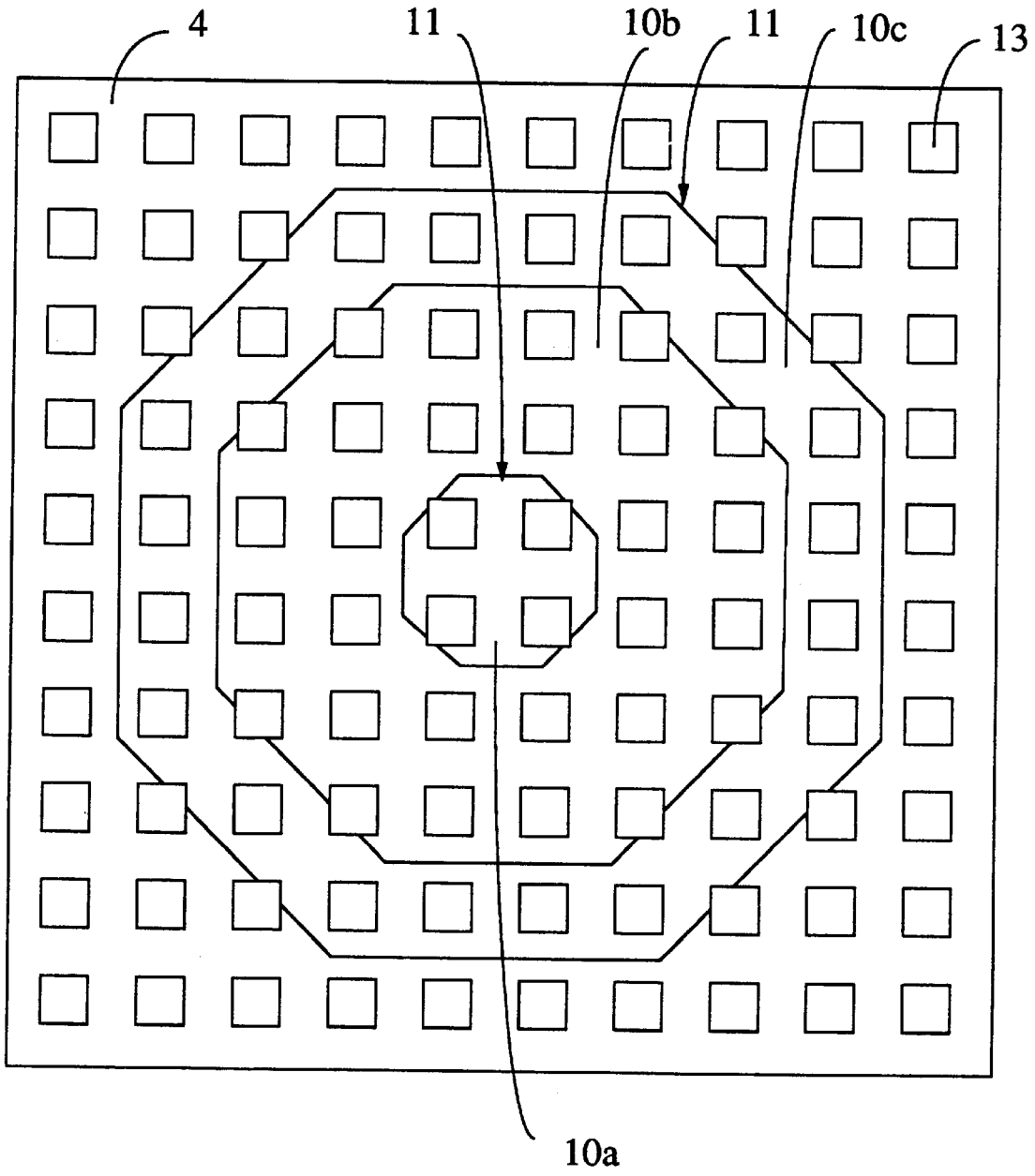
FIG. 12 is a plan view of a second substrate wherein a shape of the deflection electrode is octagon.
Figure 13:
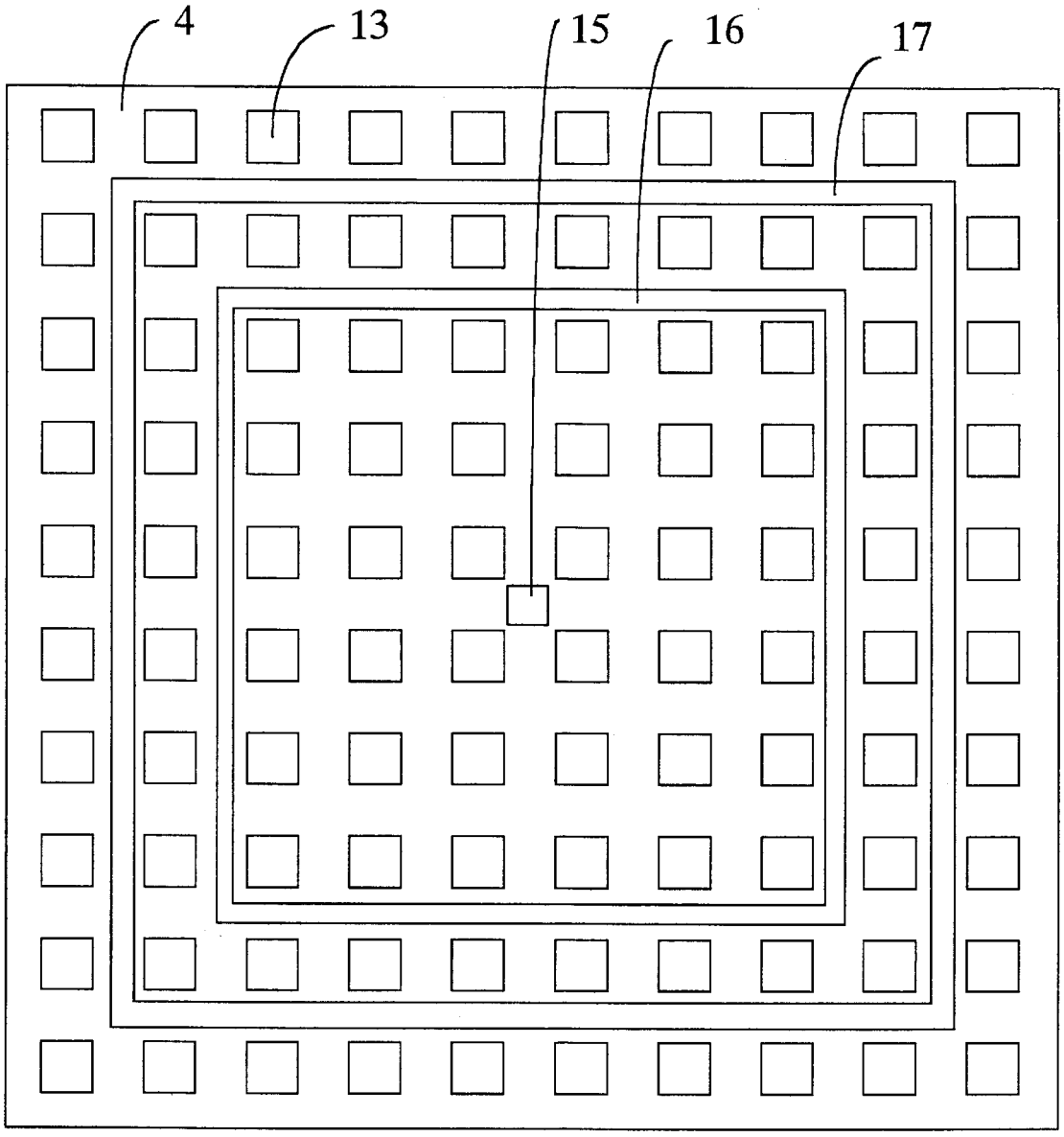
FIG. 13 is a plan view of a second substrate wherein a shape of the wall of the deflection electrode is square.
Figure 14:
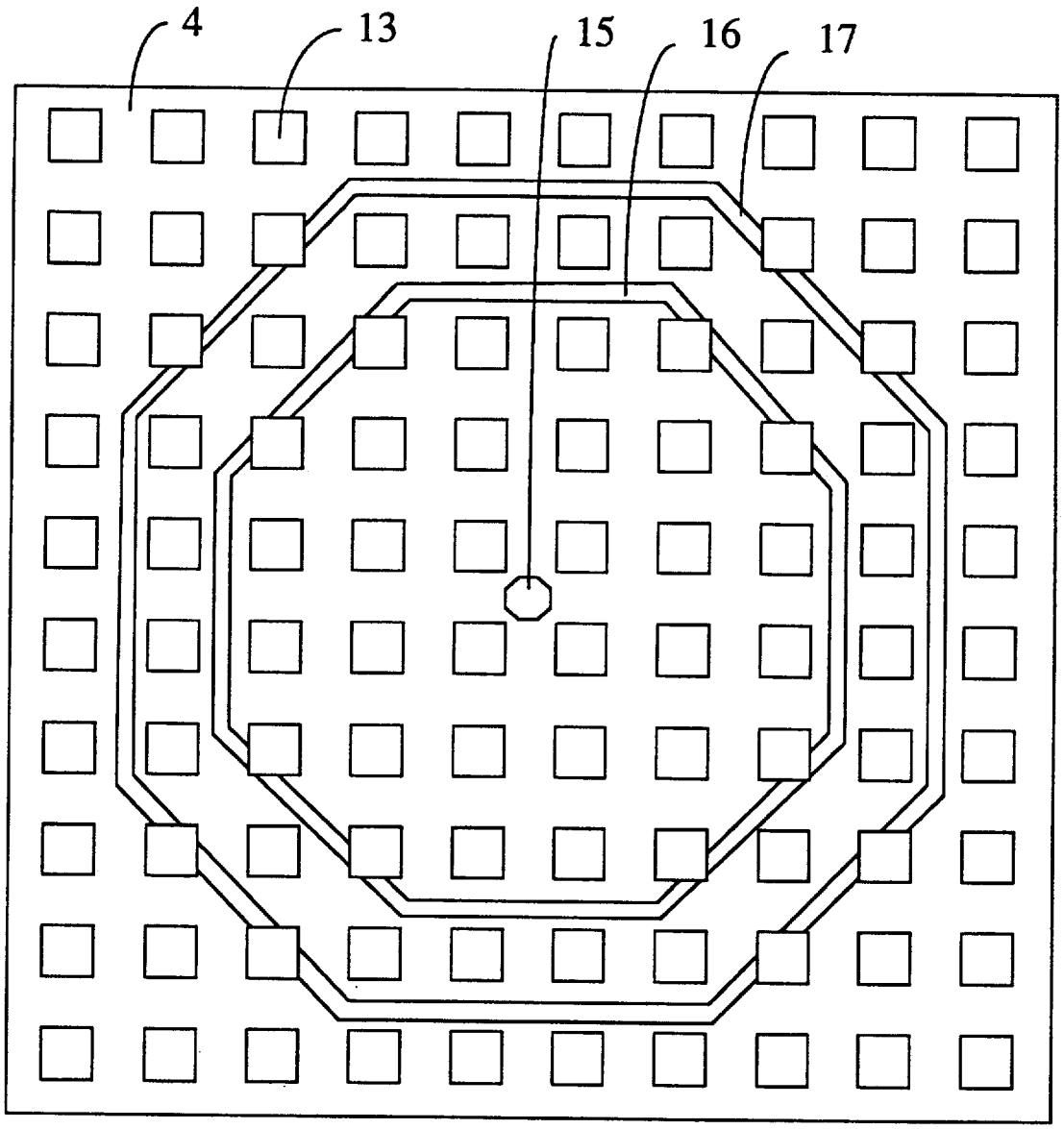
FIG. 14 is a plan view of a second substrate wherein a shape of the wall of the deflection electrode is octagon.

Some examples having square shape and octagon shape are shown in FIG. 11~FIG. 14. FIG. 11 is a plan view of a second substrate wherein a shape of the deflection electrode is square. FIG. 12 is a plan view of a second substrate wherein a shape of the deflection electrode is octagon. FIG. 13 is a plan view of a second substrate wherein a shape of the wall of the deflection electrode is square. FIG. 14 is a plan view of a second substrate wherein a shape of the wall of the deflection electrode is octagon.

Those skilled in the art will recognize that many modifications to the foregoing description can be made without departing from the spirit of the invention. The foregoing description is intended to be exemplary and in no way limiting. The scope of the invention is defined in the appended claims and equivalents thereto.

What is claimed is:

1. A display device mounted in a vacuum area between a front panel and a first base substrate, said front panel including an element for emitting light when struck by electrons and an anode electrode, said display device comprising:

a plurality of second substrates each having a smaller area than said first base substrate and arranged side-by-side on and supported by said first base substrate, each of said second substrates having electron emitting elements arranged on a surface thereof and each of said electron emitting elements having at least one emitter in electrical interconnection with a cathode.

2. A display device according to claim 1, further comprising:

deflection means, mounted on each of the second substrates, for curving a path of electrons emitted by said electron emitting elements to provide electron irradiation of a portion of said element for emitting light of said display device opposed to gaps between said second substrates.

3. A display device according to claim 2, wherein said deflection means comprises:

a plurality of conductive deflection electrodes for deflecting emitted electrons radially outward mounted around said electron emitting elements, the conductive deflection electrodes comprising at least one wall, the conductive deflection electrodes being supplied with respective different deflection voltages.

4. A display device according to claim 3, wherein said conductive deflection electrodes are formed of nickel.

5. A display device according to claim 3, wherein said conductive deflection electrodes are formed by the nickel plating.

6. A display device according to claim 3, wherein said conductive deflection electrodes are formed in a concentric circle shape.

7. A display device according to claim 3, wherein said conductive deflection electrodes are formed in a square shape.

8. A display device according to claim 3, wherein said conductive deflection electrodes are formed in a rectangular shape.

9. A display device according of claim 3, wherein said conductive deflection electrodes are formed in a polygonal shape.

10. A display device according to claim 2, wherein said deflection means comprises:

a plurality of conductive deflection electrodes for deflecting emitted electrons radially outward mounted in a gap between positions of the electron emitting elements, the conductive deflection electrodes comprising at least one wall, and the conductive deflection electrodes being supplied with a deflection voltage, said deflection electrodes being formed in a square shape.

11. A display device according to claim 1, wherein at least one support is mounted in the vacuum space between the front panel and the first base substrate.

12. A display device according to claim 3, wherein at least one support is mounted in the vacuum space between the front panel and the first base substrate.

13. A display device according to claim 1, wherein said first substrate is made of an insulating material.

14. A display device according to claim 1, wherein said first substrate is made of glass.

15. A display device mounted in a vacuum area between a front panel and a first base substrate, said front panel including an element for emitting light when struck by electrons and an anode electrode, said display device comprising:

a plurality of second substrates each having a smaller area than said first base substrate and arranged side-by-side on and supported by said first base substrate, each of said second substrates having electron emitting elements arranged on a surface thereof and each of said electron emitting elements having at least one emitter in electrical interconnection with a cathode; and deflection means, mounted on each of the second substrates, for curving a path of electrons emitted by said electron emitting elements to provide electron irradiation of a portion of said element for emitting light of said display device opposed to gaps between said second substrates, said deflection means including a plurality of conductive deflection electrodes for deflecting emitted electrons radially outward mounted around said electron emitting elements, heights of the conductive deflection electrodes decreasing toward a peripheral portion of the second substrate, a deflection voltage being applied to each of said deflection electrodes.

16. A display device according to claim 15, wherein said conductive deflection electrodes are formed of nickel.

17. A display device according to claim 15, wherein said conductive deflection electrodes are formed by the nickel plating.

18. A display device according to claim 15, wherein said conductive deflection electrodes are formed in a concentric circle shape.

19. A display device according to claim 15, wherein said conductive deflection electrodes are formed in square shape.

20. A display device according to claim 15, wherein said conductive deflection electrodes are formed in a rectangular shape.

21. A display device according of claim 15, wherein said conductive deflection electrodes are formed in a polygonal shape.

22. A display device according to claim 15, wherein at least one support is mounted in the vacuum space between the front panel and the first base substrate.

* * * * *